US006046900A

United States Patent [19]

Massey et al.

[11] Patent Number: 6,046,900

[45] Date of Patent: Apr. 4, 2000

[54] SOLENOID DRIVER CIRCUIT FOR USE WITH DIGITAL MAGNETIC LATCHING VALVES

[75] Inventors: Auldin James Massey, Ventura; Gregory Raymond Jokela, Ojai, both of Calif.

[73] Assignee: The United States of America as represented by the Secretary of the Navy, Washington, D.C.

[21] Appl. No.: 09/056,117

[22] Filed: Mar. 5, 1998

[51] Int. Cl.[7] ..... H01H 47/00

[52] U.S. Cl. ..... 361/191; 361/154; 361/210

[58] Field of Search ..... 361/152, 167, 361/154, 194, 159, 160, 166, 170, 189, 191, 206, 210; 335/230, 256, 234, 266, 253; 251/129.08

[56] References Cited

U.S. PATENT DOCUMENTS

| | | | |
|---|---|---|---|
| 3,683,239 | 8/1972 | Sturman | 361/194 |
| 3,761,730 | 9/1973 | Wright | 307/10.1 |
| 4,630,166 | 12/1986 | D'Onofrio | 361/205 |
| 4,688,138 | 8/1987 | Nagata et al. | 361/154 |
| 5,293,551 | 3/1994 | Perkins et al. | 361/154 |
| 5,644,280 | 7/1997 | Wilson et al. | 335/256 |

*Primary Examiner*—Jeffrey Gaffin
*Assistant Examiner*—Kim Huynh
*Attorney, Agent, or Firm*—David S. Kalmbaugh

[57] ABSTRACT

A driver circuit having logic circuitry which controls the coil and associated contacts of a four pole double throw relay. The four pole double throw relay is toggled such that a large latching current flows through a first of a pair of solenoid coils of the magnetic-latching solenoid, while a relatively small current flows in the second solenoid coil of the magnetic latching solenoid in an opposite direction. Toggling the relay's coil causes the latching current to now flow through the second solenoid coil of the valve, while the relatively small current flows in the first solenoid coil of the magnetic latching solenoid again in the opposite direction. This reverse current drives residual magnetism in the magnetic latching valve to about zero eliminating any holding forces so that the pulling force for moving the solenoid's actuator does not have to overcome a holding force which allows for greater holding forces at greater displacements; a simplified solenoid design and the use of magnetic materials with high magnetic permeability.

20 Claims, 4 Drawing Sheets

SOLENOID DRIVER CIRCUIT FOR USE WITH DIGITAL MAGNETIC LATCHING VALVES

BACKGROUND OF THE INVENTION

1. Field of the Invention

The present invention relates generally to solenoid driver circuits. More specifically, the present invention relates to a solenoid driver circuit which is adapted for use with the digital magnetic latching solenoids which operate the valves of a digital seawater pump.

2. Description of the Prior Art

Digital magnetic latching solenoids harness residual magnetism that remains in a magnetic material that has been exposed to a magnetic field using this residual magnetic force to control the solenoid. Magnetic latching solenoids include two opposing coils and an armature. Selectively energizing one coil at a time moves the solenoid armature in a back and forth motion to turn a valve on and off. Each coil of the magnetic latching solenoid also provides the electromagnetic field necessary to establish the residual magnetic force in the armature and solenoid housing. When the armature reaches the end of stroke and the coil turns off residual magnetic force holds the armature against the solenoid housing, locking the solenoid in one position without external power.

Residual magnetism in magnetic latching coils generates high latching forces without the disadvantages associated with permanent magnets, such as susceptibility to demagnetization, cracking, sensitivity to temperature changes and low magnetic efficiency.

Because coils in a magnetic latching solenoid are energized only for an instant, heat dissipation is of no concern. As a result the coils use larger wires with fewer turns than in conventional solenoids and have lower resistance and inductance. This allows the coils to handle high current and generate extremely strong magnetic forces without a requirement to overcome spring force which equates to fast actuation.

Although magnetic latching solenoids do not have to overcome a spring force, the latching force must overcome residual magnetism which holds the solenoid's actuator in the previously latched position. The actuator must also overcome residual magnetism from a distance which is equivalent to the solenoid actuator displacement.

As the solenoid material's magnetic permeability increases the residual magnetism increases toward saturation which makes it harder to de-latch the solenoid using only a latching current pulse. Conventional driver circuits use this latching current pulse to de-latch the solenoid's actuator from its current position.

Further, as displacement of the actuator is increased, the latching force must be decreased to de-latch the solenoid's actuator.

Thus, to design a driver for a magnetic-latching solenoid requires the designer to use sophisticated and expensive EM software and to have a thorough understanding of electromagnetic theory. There is also a need for a driver for a magnetic-latching solenoid which balances latching force requirements and solenoid displacement.

SUMMARY OF THE PRESENT INVENTION

The driver circuit of the present invention was designed to provide a large actuator displacement and a high attractive force. This, in turn, allows the driver circuit to be adapted for use in activating the magnetic-latching valves of the type used in the seawater pump disclosed in U.S. Pat. No. 5,456,581 which issued on Oct. 10, 1995 to James Massey and Gregory R. Jokela, co-inventors of the present invention.

The driver circuit of the present invention includes logic circuitry which controls the coil and associated contacts of a four pole double throw relay. The four pole double throw relay is toggled such that a large latching current flows through a first of a pair of solenoid coils of the magnetic-latching valve, while a relatively small current flows through the second solenoid coil of the magnetic latching valve in an opposite direction. Toggling the relay's coil causes the latching current to now flow through the second solenoid coil of the valve, while the relatively small current of one amp flows the first solenoid coil of the magnetic latching valve in again in the opposite direction.

This reverse current drives residual magnetism in the latched side of the solenoid to about zero eliminating any holding forces so that the pulling force for moving the solenoid's actuator does not have to overcome a holding force which allows for relatively large solenoid displacement while simultaneously allowing for significant latching forces.

DETAILED DESCRIPTION OF THE PREFERRED EMBODIMENT

Figure 1:
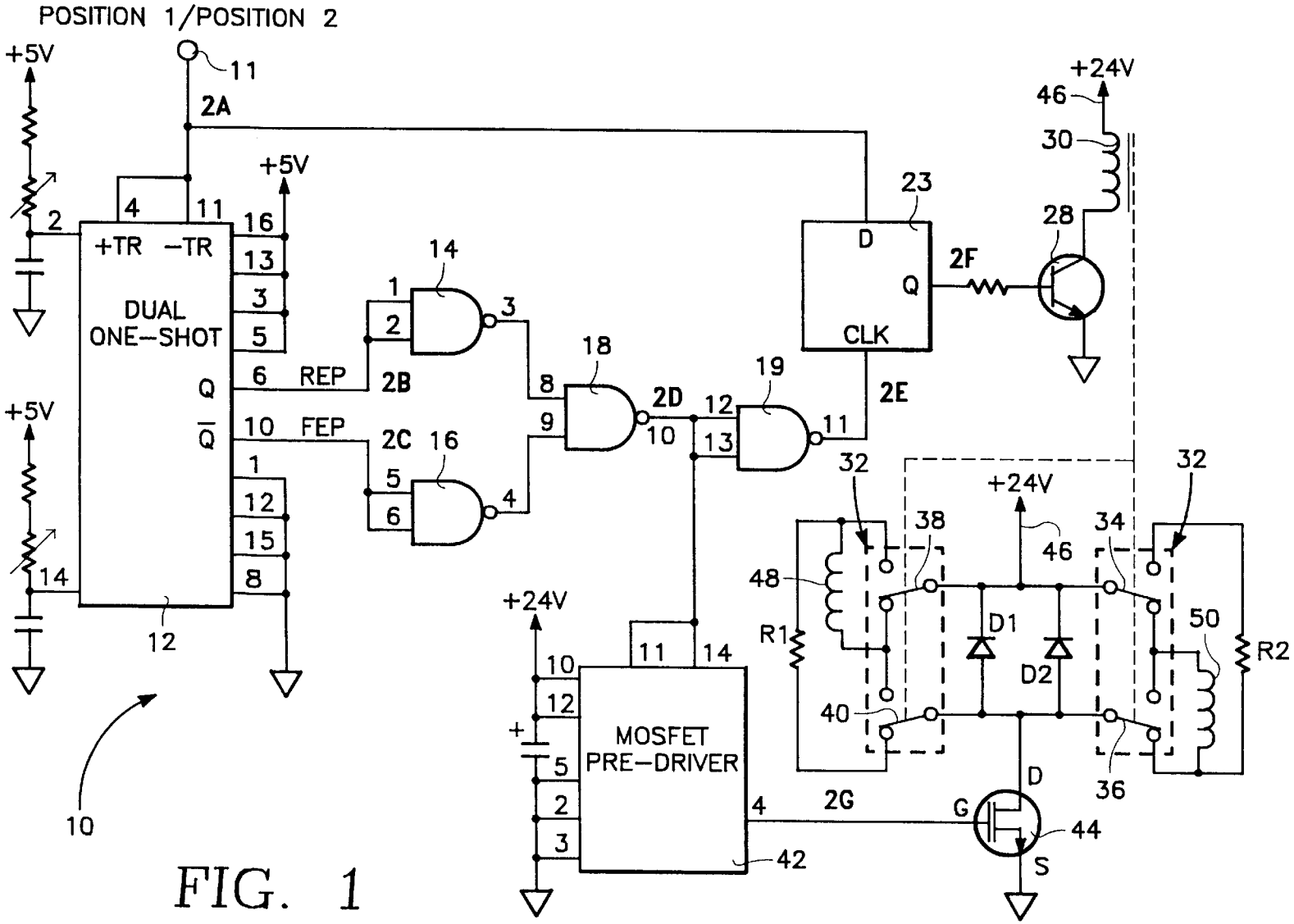
FIG. 1 is a detailed electrical schematic diagram of the solenoid driver circuit for use with digital magnetic latching valves which is a preferred embodiment of the present invention.
Figures 2A, 2B, 2C, 2D, 2E, 2F, 2G:
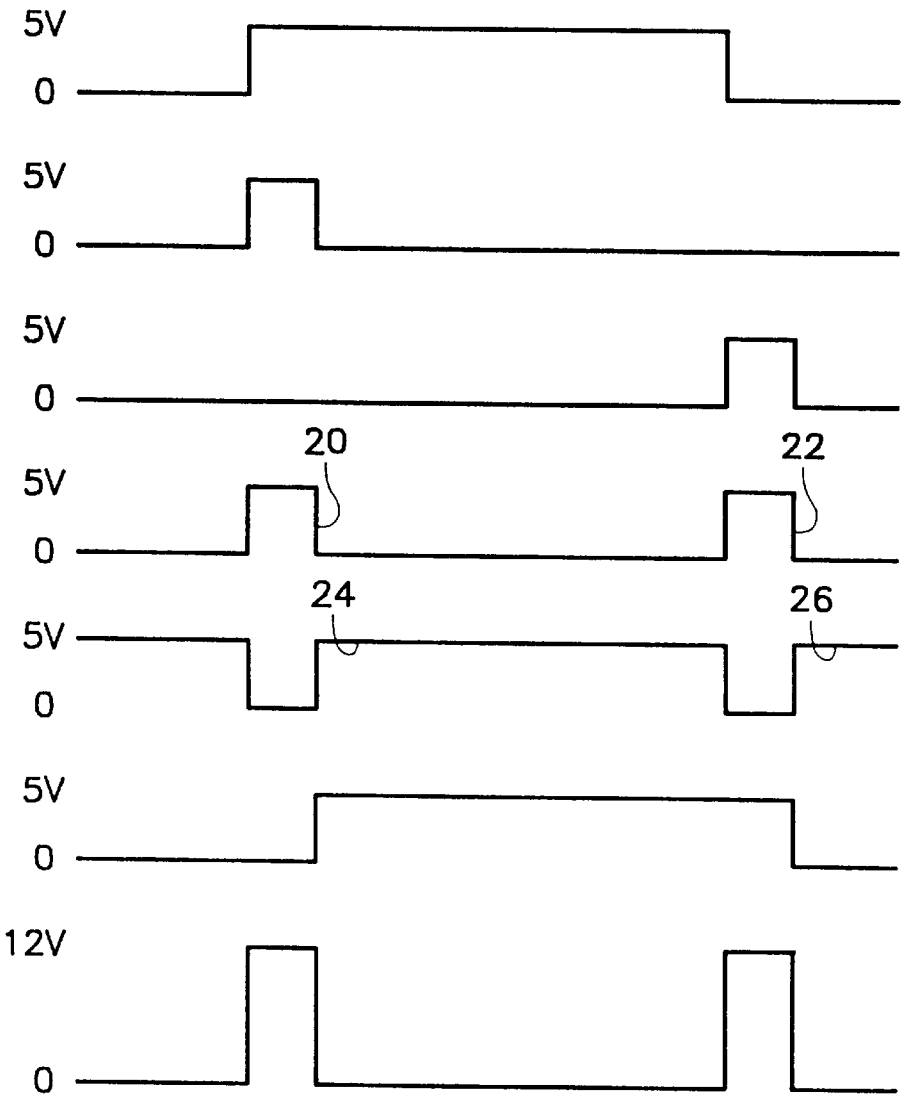
FIG. 2 is a timing diagram illustrating various waveforms which occur at the inputs and outputs of some of the electrical components of the solenoid driver circuit of FIG. 1.

Referring now to FIGS. 1 and 2, there is shown a solenoid driver circuit 10 for use with digital magnetic latching solenoids. An externally generated position 1/position 2 signal (FIG. 2A) is supplied through an input terminal 11 to the +TR and −TR inputs of a dual monostable multivibrator 12.

When the signal of FIG. 2A transitions from the logic zero state to the logic one state, multivibrator 12 generates at its Q output the rising edge pulse of FIG. 2B. In a like manner, when the signal of FIG. 2A transitions from the logic one state to the logic zero state, multivibrator 12 generates at its not Q output the falling edge pulse of FIG. 2C.

The pulse width of the pulses of FIGS. 2B and 2C are adjustable with each pulse having pulse width from about one millisecond to about four milliseconds. The pulse width is a function of the time it takes the actuator/armature of the solenoid to latch. The pulses of FIGS. 2B and 2C are turned off after the actuator/armature has reached its end of travel and sufficient time is provided to set up the required residual magnetism.

The pulse of FIG. 2B is supplied to a NAND gate 14, while the pulse of FIG. 2C is supplied to a NAND gate 16. NAND gates 14 and 16 are configured to function as NOT gates which results in the signals of FIGS. 2B and 2C being respectively inverted by NAND gates 14 and 16. The inverted signals of FIGS. 2B and 2C are next supplied to a NAND gate 18 which provides at its output the pulse signal of FIG. 2D. Pulse 20 of FIG. 2D is generated by NAND gate 18 whenever the rising edge pulse signal of FIG. 2B is at the logic one state, while pulse 22 of FIG. 2D is generated by NAND gate 18 whenever the falling edge pulse signal of FIG. 2C is at the logic one state.

The pulse signal of FIG. 2D is inverted by a NAND gate 19 resulting in the clock signal of FIG. 2E. The clock signal of FIG. 2E is next supplied to the CLK input of a D-Type Flip-Flop 23, while the signal of FIG. 2A is supplied to the D input of D-Type Flip-Flop 23. The rising edge of each clock pulse of the clock signal of FIG. 2E triggers D-Type Flip-Flop 23. The rising edge of pulse 24 triggers D-Type Flip-Flop 23 which results in the logic one at the D input of Flip-flop 23 being transferred to the Q output of D-Type Flip-Flop 23 (FIG. 2F). In a like manner, the rising edge of pulse 26 triggers D-Type Flip-Flop 23 which results in the logic zero at the D input of Flip-flop 23 being transferred to the Q output of D-Type Flip-Flop Flop 23 (FIG. 2F).

The signal of FIG. 2F is supplied to the base of an NPN transistor 28. When the signal of FIG. 2F is at the logic one state, transistor 28 is turned on allowing current to flow through relay coil 30 energizing relay coil 30 of a four pole double throw relay 32. Four pole double throw relay 32 also includes four contacts 34, 36, 38 and 40.

The pulse signal of FIG. 2D is also supplied to a MOSFET Pre-Driver 42 which then generates the 12 V gate voltage signal of FIG. 2G. The 12 V gate signal of FIG. 2G is supplied to the gate of a Field Effect Transistor 44 turning on Field Effect Transistor 44 which allows current to flow through Field Effect Transistor 44.

As depicted in FIG. 1, when Field Effect Transistor 44 is turned on, there is a first current path from voltage source 46 through contact 38 of relay 32, solenoid coil 48, a twenty seven ohm resistor R1, contact 40 of relay 42 and Field Effect Transistor 44 to ground. There is also a second current path from voltage source 46 through contact 34 of relay 32, solenoid coil 50, contact 36 of relay 42 and Field Effect Transistor 44 to ground. When the contacts are in the position shown in FIG. 1 approximately 26 amps will flow through solenoid coil 50, while only about one amp will flow through solenoid coil 48 since there is the twenty seven ohm resistor R1 in series with solenoid coil 48.

At this time it should be noted that circuit 10 includes a pair of diodes D1 and D2. The cathodes of diodes D1 and D2 are connected to source 46, while the anodes of diodes D1 and D2 are connected to the drain of Field Effect Transistor 44.

When relay coil 30 of relay 32 is again energized contacts 34, 36, 38 and 40 of relay 32 are toggled. The first current path is now from voltage source 46 through contact 38 of relay 32, solenoid coil 48, contact 40 of relay 42 and Field Effect Transistor 44 to ground. The second current path is now from voltage source 46 through contact 34 of relay 32, a twenty seven ohm resistor R2, solenoid coil 50, contact 36 of relay 42 and Field Effect Transistor 44 to ground. Approximately 26 amps now flows through solenoid coil 48, while only about one amp will flow through solenoid coil 50 since the twenty seven ohm resistor R2 is in series with solenoid coil 50.

It should be noted that the one amp current flow through coil 50 is in the opposite direction of the 26 amps which previously flowed through coil 50. Similarly, the one amp current flow through coil 48 is always in an opposite direction to the 26 amp current flow through coil 48.

The actuator/armature of the magnetic latching valve is latched by the solenoid coil of solenoid driver circuit 10 having the 26 amp current flow therethrough. For example, when a latching current of 26 amps flows through solenoid coil 48 the actuator/armature is latched by solenoid coil 48. Simultaneously, current flow through coil 50 is about 1 amp in the opposite direction to the latching current minimizing residual flux in the solenoid's magnet. This minimizes the holding force caused by current flow through coil 50.

The next pulse of the clock signal of FIG. 2E will reverse the current flow through coils 48 and 50 causing coil 50 to latch the actuator/armature of the magnetic latching valve. Current flow through coil 48 is now about 1 amp in the opposite direction of the latching current again minimizing residual flux in the valve's magnet.

Since the latching solenoid coil 48 or 50 has a 26 amp latching current flowing therethrough, the latching solenoid coil 48 or 50 will generate a large pulling force to move the valve's armature without having to overcome a large holding force.

Relay coil 30 and its contacts 34, 36, 38 and 40 are toggled by the clock signal of FIG. 2E after solenoid coils 48 and 50 are energized by the signal of FIG. 2F. Thus, the response time of relay coil 30 does not effect the actuation time of solenoid coils 48 and 50. However, the pulse repetition frequency of solenoid coils 48 and 50 is limited to approximately 100 hertz, since relay coil 30 takes as long as 10 milliseconds to toggle.

Figure 3:
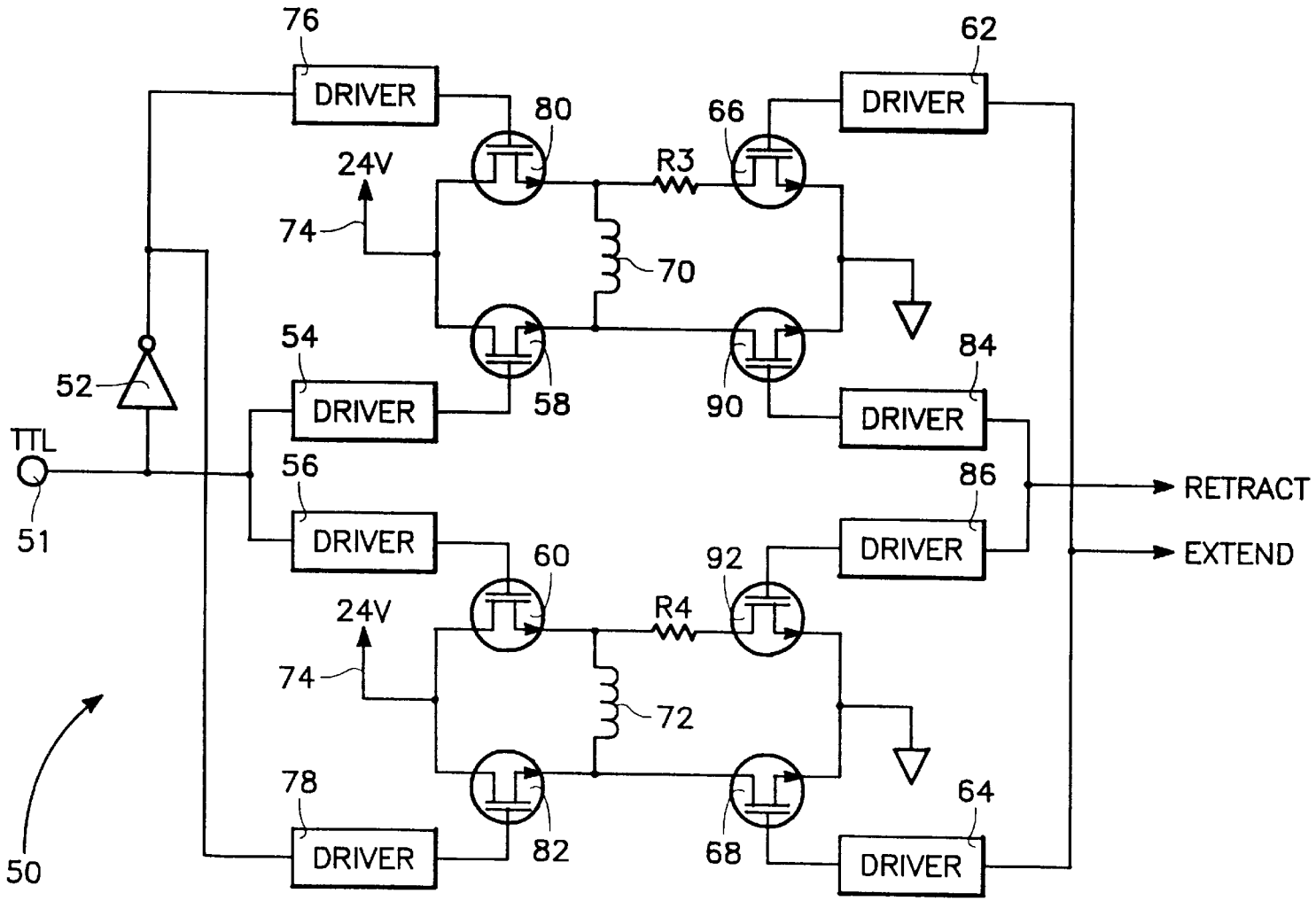
FIG. 3 is an alternate solid state embodiment of a solenoid driver circuit adapted for use with digital magnetic latching solenoids.
Figures 4A, 4B, 4C, 4D:
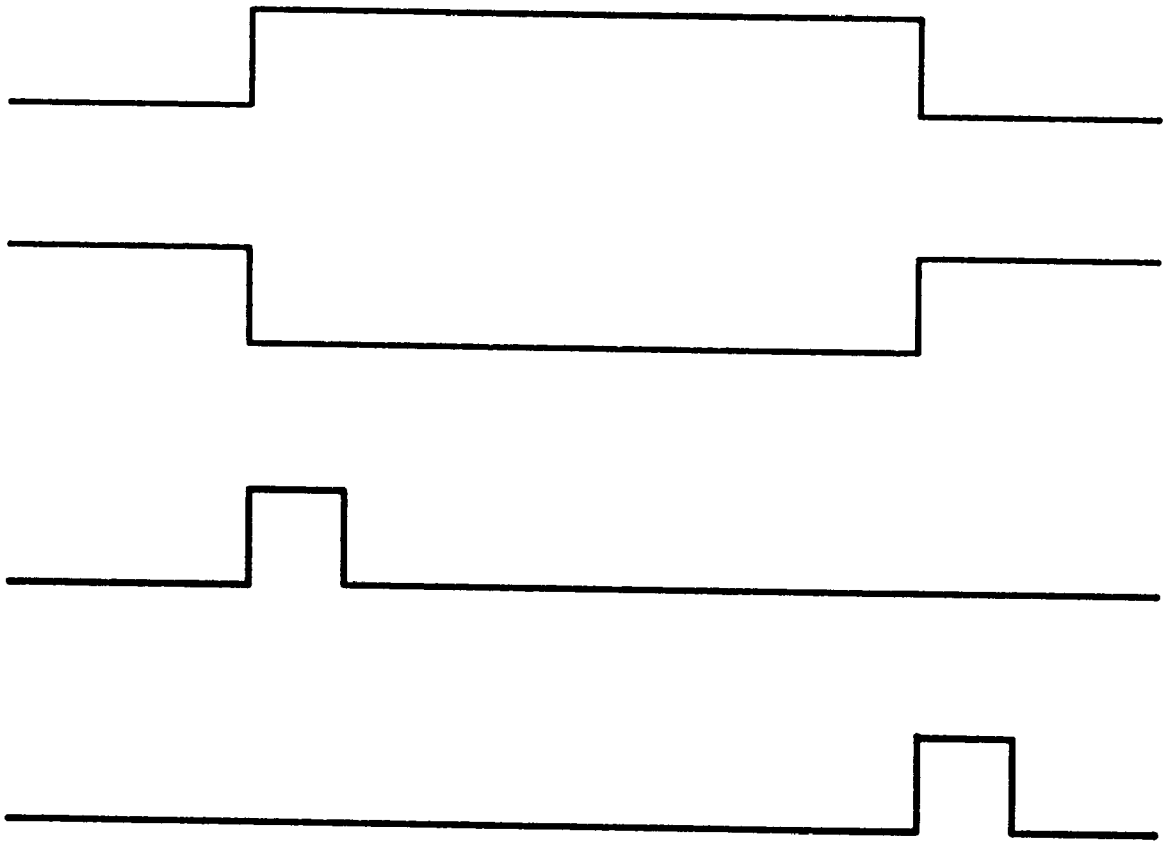
FIG. 4 is a timing diagram illustrating various waveforms which occur at the inputs and outputs of some of the electrical components of the solenoid driver circuit of FIG. 3.

Referring now to FIGS. 3 and 4, there is shown an alternate embodiment of a solenoid driver circuit 50, which is a solid state driver circuit for use with digital magnetic latching solenoids. A pulse signal (FIG. 4A) is supplied through an input terminal 51 to an inverter 52 and drivers 54 and 56. When the signal of FIG. 4A is at the logic one state, drivers 54 and 56 respectively turn on Field Effect Transistors 58 and 60. Simultaneously, an extend pulse signal (FIG. 4C) is provided to drivers 62 and 64. When the signal of FIG. 4C is at the logic one state, drivers 62 and 64 respectively turn on Field Effect Transistors 66 and 68.

There is a first current path from 24 VDC source 74 through Field Effect Transistor 58, solenoid coil 70, resistor R3 and Field Effect Transistor 66 to ground. Simultaneously, there is a second current path from source 74 through Field Effect Transistor 60, solenoid coil 72 and Field Effect Transistor 68 to ground. This results in a large current flow through solenoid coil 72 and a relatively small current flow through solenoid coil 70, which extends the actuator/armature of the magnetic latching valve.

The pulse signal of FIG. 4A is inverted by inverter 52 resulting in the inverted pulse signal of FIG. 4B. When the signal of FIG. 4B is at the logic one state, drivers 76 and 78 respectively turn on Field Effect Transistors 80 and 82. Simultaneously, a retract pulse signal (FIG. 4D) is provided to drivers 62 and 64. When the signal of FIG. 4D is at the logic one state, drivers 84 and 86 respectively turn on Field Effect Transistors 90 and 92.

The first current path is now from source 74 through Field Effect Transistor 80, solenoid coil 70 and Field Effect Transistor 90 to ground. Simultaneously, the second current path is now from source 74 through Field Effect Transistor 82, solenoid coil 72, Resistor R4 and Field Effect Transistor 92 to ground. This results in a large current flow through solenoid coil 70 and a relatively small current flow through solenoid coil 72, which retracts the actuator/armature of the magnetic latching valve.

It should be noted that the value for resistors R3 and R4 is approximately 27 ohms. It should also be noted that circuit 50 does not limit the pulse repetition frequency as does circuit 10 which uses relay coil 30 and its associated contacts 34, 36, 38 and 40 to operate the solenoid coils of the magnetic latching valve. This, in turn, allows high speed control of the forces acting on the solenoid actuator of the valve and thus allows velocity control of the actuator/armature.

For example, rapid changes in force and direction could be made during actuator movement. Prior to contact actuator movement would slow down and then the latching force would increase after contact. This functions to quiet the solenoid's operation and extends the life of solenoid.

From the foregoing, it may readily be seen that the present invention comprises a new, unique and exceedingly solenoid driver circuit for use with digital magnetic latching valves which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A solenoid driver circuit adapted for use with a digital magnetic latching valve, said digital magnetic latching valve having a first solenoid coil and a second solenoid coil, said solenoid driver circuit comprising:

signal generating means for receiving an externally generated position one/position two logic signal, said signal generating means responsive to said externally generated position one/position two logic signal generating a clock signal having a plurality of clock pulses and a gate voltage signal having a plurality of gate voltage pulses;

Flip-Flop means for receiving said externally generated position one/position two logic signal and said clock signal, said Flip-Flop means, responsive to each of said plurality of clock pulses of said clock signal, delaying and then passing said externally generated position one/position two logic signal through said Flip-Flop means to a Q output of said Flip-Flop means to provide a delayed position one/position two logic signal;

a relay having a relay coil and first, second, third and fourth relay contacts, the first and third relay contacts of said relay being connected to said first solenoid coil, the second and fourth relay contacts of said relay being connected to said second solenoid coil;

first transistor means connected to the Q output of said Flip-Flop means to receive said delayed position one/position two logic signal, said first transistor means being connected to the relay coil of said relay, said first transistor means energizing the relay coil of said relay whenever said delayed position one/position two logic signal is at a first logic state;

second transistor means for receiving said gate voltage signal, each of said plurality of gate voltage pulses turning on said second transistor means;

said first, second, third and fourth relay contacts of said relay being toggled whenever said relay coil is energized to provide an electrical circuit which alternately has a predetermined resistance value coupled to only one of said first and second solenoid coils to reduce current flow to a predetermined amperage level through said one of said first and second solenoid coils having said predetermined resistance value coupled thereto;

said second transistor means energizing said first solenoid coil and said second solenoid coil whenever second transistor means is turned on.

2. The solenoid driver circuit of claim 1 wherein said signal generating means comprises:

a dual monostable multivibrator having a positive trigger input, a negative trigger input and a Q output and a not Q output, said positive trigger input and said negative trigger input receiving an externally generated position one/position two logic signal;

a first NAND gate having first and second inputs connected to the Q output of said dual monostable multivibrator and an output;

a second NAND gate having first and second inputs connected to the not Q output of said dual monostable multivibrator and an output;

a third NAND gate having a first input connected the output of said first NAND gate, a second input connected to the output of said second NAND gate and an output;

a fourth NAND gate having first and second inputs connected to the output of said third NAND gate and an output connected to said Flip-Flop means;

a pre-driver having an input connected to the output of said third NAND gate and an output to said second transistor means.

3. The solenoid driver circuit of claim 1 wherein said Flip-Flop means comprises a D-type Flip-Flop.

4. The solenoid driver circuit of claim 1 wherein said first transistor means comprises an NPN transistor.

5. The solenoid driver circuit of claim 1 wherein said second transistor means comprises a Field Effect Transistor.

6. The solenoid driver circuit of claim 1 wherein said predetermined resistance value is about twenty seven ohms.

7. The solenoid driver circuit of claim 1 wherein said predetermined amperage level is about one amp.

8. A solenoid driver circuit adapted for use with a digital magnetic latching valve, said digital magnetic latching valve having a first solenoid coil and a second solenoid coil, said solenoid driver circuit comprising:

multivibrator means for receiving an externally generated position one/position two logic signal, said multivibrator means responsive to said externally generated position one/position two logic signal generating a rising edge pulse signal and a falling edge pulse signal;

gating means for combining said rising edge pulse signal and said falling edge pulse signal to form a pulse signal having a plurality of pulses;

inverting means for inverting said pulse signal to form a clock signal having a plurality of clock pulses;

Flip-Flop means for receiving said externally generated position one/position two logic signal and said clock signal, said Flip-Flop means, responsive to each of said plurality of clock pulses of said clock signal, delaying and then passing said externally generated position one/position two logic signal through said Flip-Flop means to a Q output of said Flip-Flop means to provide a delayed position one/position two logic signal;

a relay having a relay coil and first, second, third and fourth relay contacts, the first and third relay contacts of said relay being connected to said first solenoid coil, the second and fourth relay contacts of said relay being connected to said second solenoid coil;

first transistor means connected to the Q output of said Flip-Flop means to receive said delayed position one/position two logic signal, said first transistor means being connected to the relay coil of said relay, said first transistor means energizing the relay coil of said relay whenever said delayed position one/position two logic signal is at a first logic state;

driver means for receiving said pulse signal, said driver means responsive to said pulse signal generating a gate voltage signal having a plurality of gate voltage pulses;

second transistor means for receiving said gate voltage signal, each of said plurality of gate voltage pulses turning on said second transistor means;

said first, second, third and fourth relay contacts of said relay being toggled whenever said relay coil is energized to provide an electrical circuit which alternately has a predetermined resistance value coupled to only one of said first and second solenoid coils to reduce current flow to a predetermined amperage level through said one of said first and second solenoid coils having said predetermined resistance value coupled thereto;

said second transistor means energizing said first solenoid coil and said second solenoid coil whenever second transistor means is turned on.

9. The solenoid driver circuit of claim 8 wherein said multivibrator means comprises a dual monostable multivibrator.

10. The solenoid driver circuit of claim 8 wherein said gating means comprises:

a first NAND gate having first and second inputs connected to a Q output of said multivibrator means and an output;

a second NAND gate having first and second inputs connected to a not Q output of said multivibrator means and an output;

a third NAND gate having a first input connected the output of said first NAND gate, a second input connected to the output of said second NAND gate and an output connected to an input of said inverting means.

11. The solenoid driver circuit of claim 8 wherein said inverting means comprises a two input NAND gate.

12. The solenoid driver circuit of claim 8 wherein said Flip-Flop means comprises a D-type Flip-Flop.

13. The solenoid driver circuit of claim 8 wherein said first transistor means comprises an NPN transistor.

14. The solenoid driver circuit of claim 8 wherein said second transistor means comprises a Field Effect Transistor.

15. The solenoid driver circuit of claim 8 wherein said predetermined resistance value is about twenty seven ohms.

16. The solenoid driver circuit of claim 8 wherein said predetermined amperage level is about one amp.

17. A solenoid driver circuit adapted for use with a digital magnetic latching valve, said digital magnetic latching valve having a first solenoid coil and a second solenoid coil, said solenoid driver circuit comprising:

a dual monostable multivibrator having a positive trigger input, a negative trigger input and a Q output and a not Q output, said positive trigger input and said negative trigger input receiving an externally generated logic signal;

a first NAND gate having first and second inputs connected to the Q output of said dual monostable multivibrator and an output;

a second NAND gate having first and second inputs connected to the not Q output of said dual monostable multivibrator and an output;

a third NAND gate having a first input connected the output of said first NAND gate, a second input connected to the output of said second NAND gate and an output;

a fourth NAND gate having first and second inputs connected to the output of said third NAND gate and an output;

a pre-driver having an input connected to the output of said third NAND gate and an output;

a D-Type Flip-Flop having a D input for receiving said externally generated logic signal, a clock input connected to the output of said fourth NAND gate and a Q output;

a transistor having a base connected to the Q output of said D-Type Flip-Flop, an emitter connected to ground and a collector;

a direct current voltage source having an output;

a relay having a coil and first, second, third and fourth relay contacts, the coil of said relay having a first terminal connected to the output of said direct current voltage source and a second terminal connected to the collector of said transistor;

said first, second, third and fourth relay contacts of said relay each having first, second and third terminals;

the first terminal of said first relay contact being connected to the output of said direct current voltage source, the second terminal of said first relay contact being connected to a first terminal of said first solenoid coil and the third terminal of said first relay contact being connected to a second terminal of said first solenoid coil;

the first terminal of said second relay contact being connected to the output of said direct current voltage source, the second terminal of said second relay contact being connected to a first terminal of said second solenoid coil;

a Field Effect Transistor having a gate connected to the output of said pre-driver, a drain and a source connected to ground;

the first terminal of said third relay contact being connected to the drain of said Field Effect Transistor, the second terminal of said third relay contact being connected to the second terminal of said first solenoid coil;

the first terminal of said fourth relay contact being connected to the drain of said Field Effect Transistor, the second terminal of said fourth relay contact being connected to the second terminal of said second solenoid coil and the third terminal of said fourth relay contact being connected to a second terminal of said second solenoid coil;

a first resistor having a first terminal connected to the third terminal of said third relay contact and a second terminal connected to the first terminal of said first solenoid coil; and a second resistor having a first terminal connected to the second terminal of said second solenoid coil and a second terminal connected to the third terminal of said second relay contact.

18. The solenoid circuit driver of claim 17 further comprising:

a first diode having an anode connected to the drain of said Field Effect Transistor and a cathode connected to the output of said direct current voltage source; and a second diode having an anode connected to the drain of said Field Effect Transistor and a cathode connected to the output of said direct current voltage source.

19. The solenoid circuit driver of claim 17 wherein said direct current voltage source comprises a twenty four volt direct current voltage source.

20. The solenoid circuit driver of claim 17 wherein said first resistor and said second resistor each have a resistance of about twenty seven ohms.

* * * * *